US007510274B2

(12) United States Patent
Davis et al.

(10) Patent No.: US 7,510,274 B2
(45) Date of Patent: Mar. 31, 2009

(54) INK DELIVERY SYSTEM AND METHODS FOR IMPROVED PRINTING

(75) Inventors: Jeremy A Davis, Battle Ground, WA (US); Melissa S. Gedraitis, Circle Camas, WA (US); Marc A. Baldwin, Corvallis, OR (US); Louis Barinaga, Vancouver, WA (US); Daniel D Dowell, Albany, OR (US); Ashley E Childs, Corvallis, OR (US); Mark A. Smith, Corvallis, OR (US); Charles R. Steinmetz, Corvallis, OR (US); Ralph L. Stathem, Lebanon, OR (US); Jeffrey D. Langford, Lebanon, OR (US); Michael L. Hilton, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 27 days.

(21) Appl. No.: 11/040,941

(22) Filed: Jan. 21, 2005

(65) Prior Publication Data

US 2006/0164473 A1 Jul. 27, 2006

(51) Int. Cl.
*B41J 2/19* (2006.01)
*B41J 2/18* (2006.01)

(52) U.S. Cl. ..... 347/92; 347/89

(58) Field of Classification Search ..... 347/84, 347/85, 86, 87, 89, 92; 141/2, 18
See application file for complete search history.

(56) References Cited

U.S. PATENT DOCUMENTS

| | | | |
|---|---|---|---|
| 3,739,717 | A | 6/1973 | Brown et al. |
| 4,184,169 | A | 1/1980 | Taylor et al. |
| 4,303,929 | A | 12/1981 | Blanck |
| 4,329,696 | A | 5/1982 | Denlinger et al. |
| 4,333,088 | A | 6/1982 | Diggins |
| 4,336,037 | A | 6/1982 | Goldis et al. |
| 4,340,895 | A | 7/1982 | Kikuchi |
| 4,359,744 | A | 11/1982 | Salmre |
| 4,364,059 | A | 12/1982 | Nagayama |
| 4,368,478 | A | 1/1983 | Koto |
| 4,376,283 | A | 3/1983 | Bower |
| 4,380,770 | A | 4/1983 | Maruyama |
| 4,399,446 | A | 8/1983 | McCann et al. |

(Continued)

FOREIGN PATENT DOCUMENTS

| | | |
|---|---|---|
| EP | 1359026 | 11/2003 |

(Continued)

OTHER PUBLICATIONS

International Publication No. WO2004/096560 A2 Publication Date Nov. 11, 2004 for International Application No. PCT/US/2004/013164, filing date Apr. 29, 2004.

*Primary Examiner*—Anh T. N. Vo

(57) ABSTRACT

An ink delivery system having at least one off-axis ink supply container and an on-axis printhead assembly. The printhead assembly includes at least one reservoir and a corresponding standpipe separated by a particle filter. At least one tube connects the off-axis ink supply container to the printhead assembly. A first valve is configured to selectively open a flow path between the tube and the reservoir. A second valve is configured to selectively open a flow path between the standpipe and the tube.

12 Claims, 6 Drawing Sheets

U.S. PATENT DOCUMENTS 4,403,227 A 9/1983 Bertschy et al.
4,403,229 A 9/1983 Barteck
4,413,267 A 11/1983 Hein
4,476,472 A 10/1984 Aiba et al.
4,494,124 A 1/1985 Piatt et al.
4,502,054 A 2/1985 Brescia et al.
4,502,055 A 2/1985 Horike et al.
4,527,175 A 7/1985 Kojima et al.
4,536,776 A 8/1985 Knirsch et al.
4,599,624 A 7/1986 Aiba et al.
4,619,842 A 10/1986 Moss et al.
4,658,268 A 4/1987 Needham
4,680,696 A * 7/1987 Ebinuma et al. ..... 347/85
4,727,378 A 2/1988 Le et al.
4,811,035 A 3/1989 Huliba et al.
4,835,554 A 5/1989 Hoisington et al.
4,837,585 A 6/1989 Williams et al.
4,862,192 A 8/1989 Slomianny
4,870,431 A 9/1989 Sousa et al.
4,897,762 A * 1/1990 Daikoku et al. ..... 361/689
4,929,963 A 5/1990 Balazar
4,937,598 A 6/1990 Hine et al.
4,940,995 A 7/1990 Hine et al.
5,121,130 A 6/1992 Hempel et al.
5,189,438 A 2/1993 Hine et al.
5,291,215 A 3/1994 Nozawa et al.
5,331,339 A 7/1994 Takahashi
5,341,162 A 8/1994 Hermanson et al.
5,459,497 A 10/1995 Manning et al.
5,466,073 A 11/1995 Rossi et al.
5,532,720 A 7/1996 Krueger et al.
5,704,403 A * 1/1998 Schwenk et al. ..... 141/18
5,751,300 A * 5/1998 Cowger et al. ..... 347/6
5,757,405 A 5/1998 Bainvel et al.
5,818,485 A * 10/1998 Rezanka ..... 347/89
5,831,655 A 11/1998 Asawa et al.
5,870,126 A 2/1999 Kondo et al.
5,936,650 A * 8/1999 Ouchida et al. ..... 347/89
5,943,078 A 8/1999 Nishimoto et al.
5,956,062 A 9/1999 Omata et al.
6,000,792 A 12/1999 Koizumi
6,033,061 A 3/2000 Niedermeyer et al.
6,041,709 A 3/2000 Wells et al.
6,231,174 B1 5/2001 Haigo
6,241,344 B1 6/2001 Machida
6,331,050 B1 12/2001 Nakata et al.
6,371,607 B2 * 4/2002 Wouters et al. ..... 347/89
6,428,156 B1 8/2002 Waller et al.
6,478,415 B2 * 11/2002 Barinaga et al. ..... 347/85
6,485,137 B2 11/2002 Karlinski et al.
6,491,368 B1 12/2002 Cipolla et al.
6,517,189 B2 2/2003 Ogawa et al.
6,652,080 B2 11/2003 Childs et al.
6,742,882 B2 6/2004 Nakamura
6,752,493 B2 6/2004 Dowell et al.
7,033,006 B2 * 4/2006 Ebisawa et al. ..... 347/85
2001/0013882 A1 8/2001 Niedermeyer et al.
2002/0063763 A1 5/2002 Mantell et al.
2003/0007047 A1 1/2003 Otsuka et al.
2003/0202057 A1 10/2003 Childs et al.
2003/0202072 A1 10/2003 Childs et al.
2003/0202073 A1 10/2003 Dowell et al.
2004/0085416 A1 5/2004 Kent
2005/0007427 A1 1/2005 Bellinger et al.

FOREIGN PATENT DOCUMENTS

EP 1359027 11/2003
JP 10329342 A 12/1998
JP 200289222 A 10/2000
JP 2003011380 A 1/2003
JP 2004202799 A 7/2004

* cited by examiner

INK DELIVERY SYSTEM AND METHODS FOR IMPROVED PRINTING

BACKGROUND

Ink delivery systems are utilized by various types of printers to generate text and/or images on a printing medium, such as paper, normally in response to communications and/or control signals from a computer. One known type of ink delivery system includes a printhead assembly that is configured to slide along a shaft in response to communications and/or control signals from a computer. As the printhead assembly slides along the shaft, ink is ejected through nozzles disposed in the printhead assembly onto the print medium to generate the text and/or images. The printhead assembly is said to be positioned "on-axis" because it is coupled to the shaft. While the printhead assembly may have one or more integral ink reservoirs (one per color), the primary bulk supply of ink is located in one or more ink supply containers (one per color) located somewhat remote from the shaft and printhead (though still within the printer), which is referred to as "off-axis" positioning. Typically, the printer includes a plurality of off-axis ink supply containers, each containing a different color or type of ink. The ink supply containers are connected to the printhead assembly by tubes, which provide fluid communication between the ink supply containers and the printhead assembly. Ink is supplied from the ink supply containers through the respective tubes to the printhead assembly at various times.

With such ink delivery systems, there is a desire to reduce or prevent air accumulation in various parts of the printhead assembly, because an over-accumulation of air in the printhead assembly can degrade the printing quality and/or reduce the usable life of the printhead assembly. There is a further desire to reduce or prevent water evaporation through the nozzles, for example, during long duration storage, because such may leave accretions in the nozzle bore made up of the non-volatile ink components. Another desire is to reduce or prevent obstructions, including kinks, in the tubes connecting the off-axis ink supply containers to the printhead assembly.

The embodiments described hereinafter were developed in light of these and other desires.

DETAILED DESCRIPTION

Systems and methods for improved ink delivery in an ink jet delivery system are disclosed. One exemplary system includes an on-axis printhead assembly having one or more ink reservoirs and a plurality of corresponding nozzles used to eject ink from the respective reservoirs onto a print medium, such as paper. The printhead includes a reservoir for each color printable by the printer. Each reservoir is fluidically connected to a group of corresponding nozzles through a fluid channel. A particle filter is disposed between each reservoir and the nozzles to filter unwanted particles as the ink flows from the reservoir to the nozzles. The system further includes one or more off-axis ink supply containers for storing quantities of ink. Each reservoir in the printhead assembly is typically fed by a corresponding off-axis ink supply container. The system includes a first flow path between each off-axis supply container and the corresponding reservoir of the printhead assembly (upstream of the filter). Further, the system includes a second flow path between each off-axis supply container and the fluid channel downstream of the filter. The first flow path facilitates the delivery of ink from the off-axis supply container to the corresponding reservoir and to evacuate air from the printhead assembly upstream of the filter. The second flow path is used to evacuate air from the printhead assembly downstream of the filter. Portions of the first and second flow paths may be shared. A bi-directional pump or the like is used to evacuate air through the first and second flow paths. Further, the pump and air/ink sensor are used with the second flow path and the first flow path to determine if accretions have formed in the tubes and to remove such accretions from the ink delivery system. Finally, the pump is used with the second flow path to aid in the removal of accretions.

Figure 1:
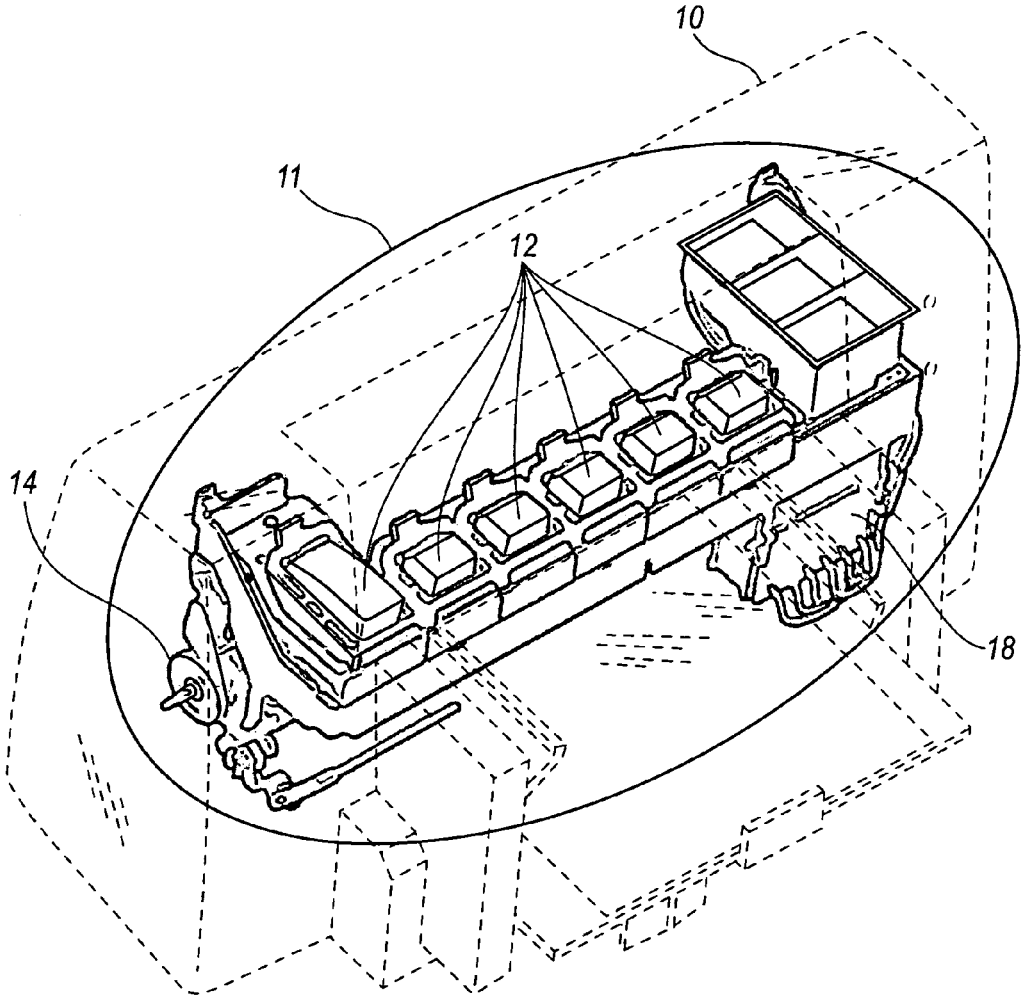
FIG. 1 illustrates an ink delivery system in a printing device, according to an embodiment.

Referring now to FIG. 1, a printing device 10 is shown according to an embodiment. Printing device 10 is used to generate text and/or images on a printing medium, such as paper. Printing device 10 includes an ink delivery system 11. The ink delivery system includes a printhead assembly 18 and, in this embodiment, a plurality of off-axis ink supply containers 12 (*a-f*) (collectively referred to as element 12) that each store a supply of a different color of ink. The ink supply containers 12 are fluidically connected to corresponding reservoirs (not shown in FIG. 1) in the printhead assembly 18 via one or more flow paths (not shown in FIG. 1), which may consist of plastic tubes. Bi-directional pump 14 causes ink to be pumped through the flow paths, both toward the printhead assembly 18, and away from the printhead assembly 18, depending on the activation direction of the pump. Various types of bi-directional pumps may be used, including peristaltic pumps. In some embodiments, bi-directional pump 14 includes an "idle" state. The pump is controlled by a controller and/or electronic control circuit (not shown).

Figure 2:
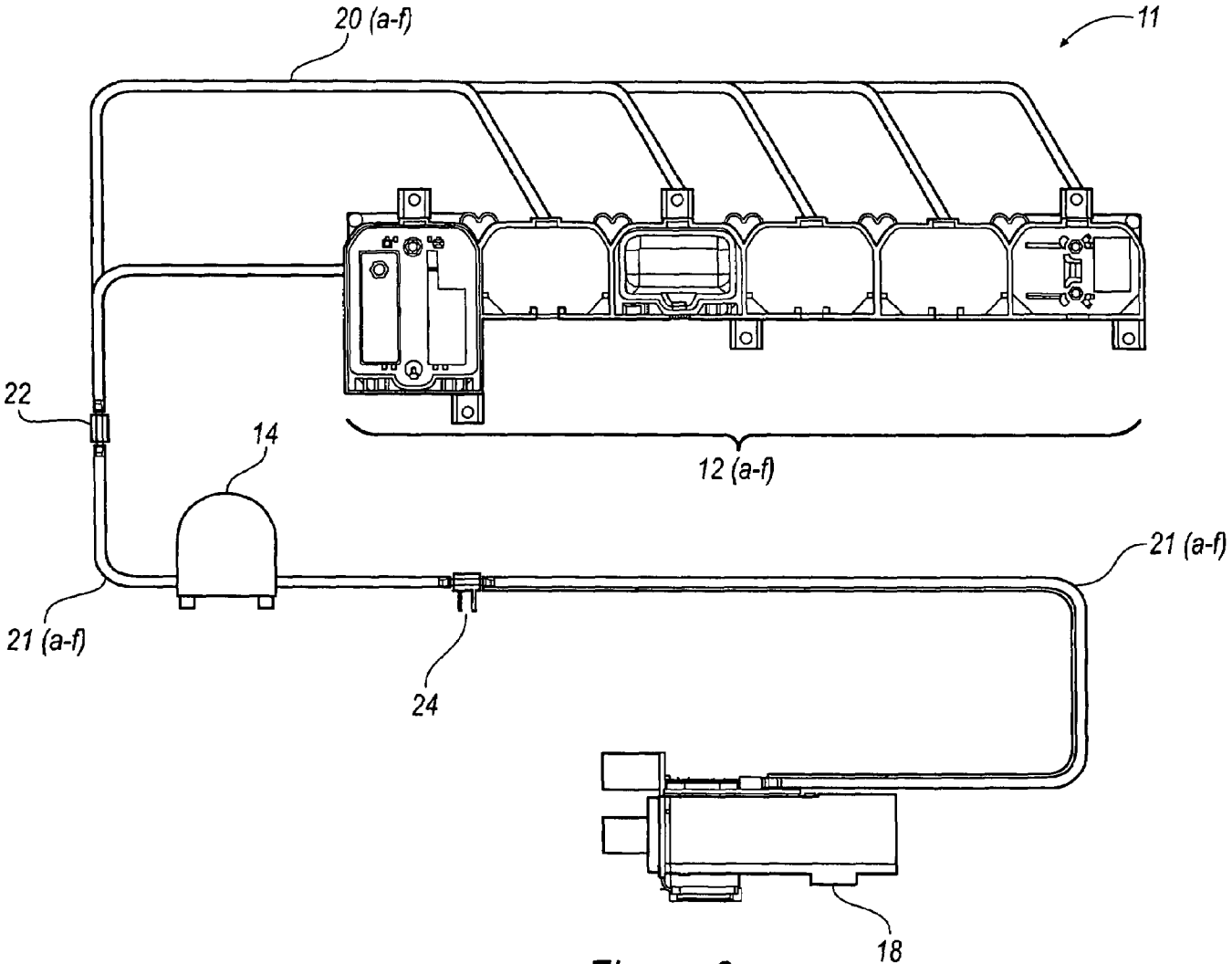
FIG. 2 illustrates a more detailed view of the ink delivery system of FIG. 1, according to an embodiment.

FIG. 2 illustrates the exemplary ink delivery system 11 in more detail. Off-axis ink supply containers 12(*a-f*) are each connected to corresponding reservoirs (not shown in FIG. 2) in the printhead assembly 18 through tubes 20(*a-f*) and 21(*a-f*). Tubes 20(*a-f*) and 21(*a-f*) are connected by coupling 22. In some embodiments, tubes 20(*a-f*) are static or rigid, and tubes 21(*a-f*) are dynamic or flexible to accommodate the moving printhead assembly 18. Further, in some embodiments, tubes 20(*a-f*) and 21(*a-f*) can both be dynamic or both be static. Further, in some embodiments—particularly where tubes 20(*a-f*) and 21(*a-f*) are both made from the same material—tubes 20(*a-f*) and 21(*a-f*) may be integral, thereby eliminating the need for coupling 22. In other embodiments, each off-axis ink supply container 12 may correspond to and be fluidically connected to the printhead assembly 18 by a plurality of tubes 12, instead of just one as shown in FIG. 2. Bi-directional pump 14 and air/ink sensor 24 are both interposed in the flow path between ink supply containers 12(*a-f*) and printhead assembly 18 (shown as interposed in tube 21(*a-f*) in FIG. 2). The bi-directional pump 14 is configured to selectively move ink and/or air in either direction in the flow path between the ink supply containers 12(*a-f*) and the printhead assembly 18. The air/ink sensor 24 is configured to sense and distinguish between air and/or ink passing therethrough.

Figure 3:
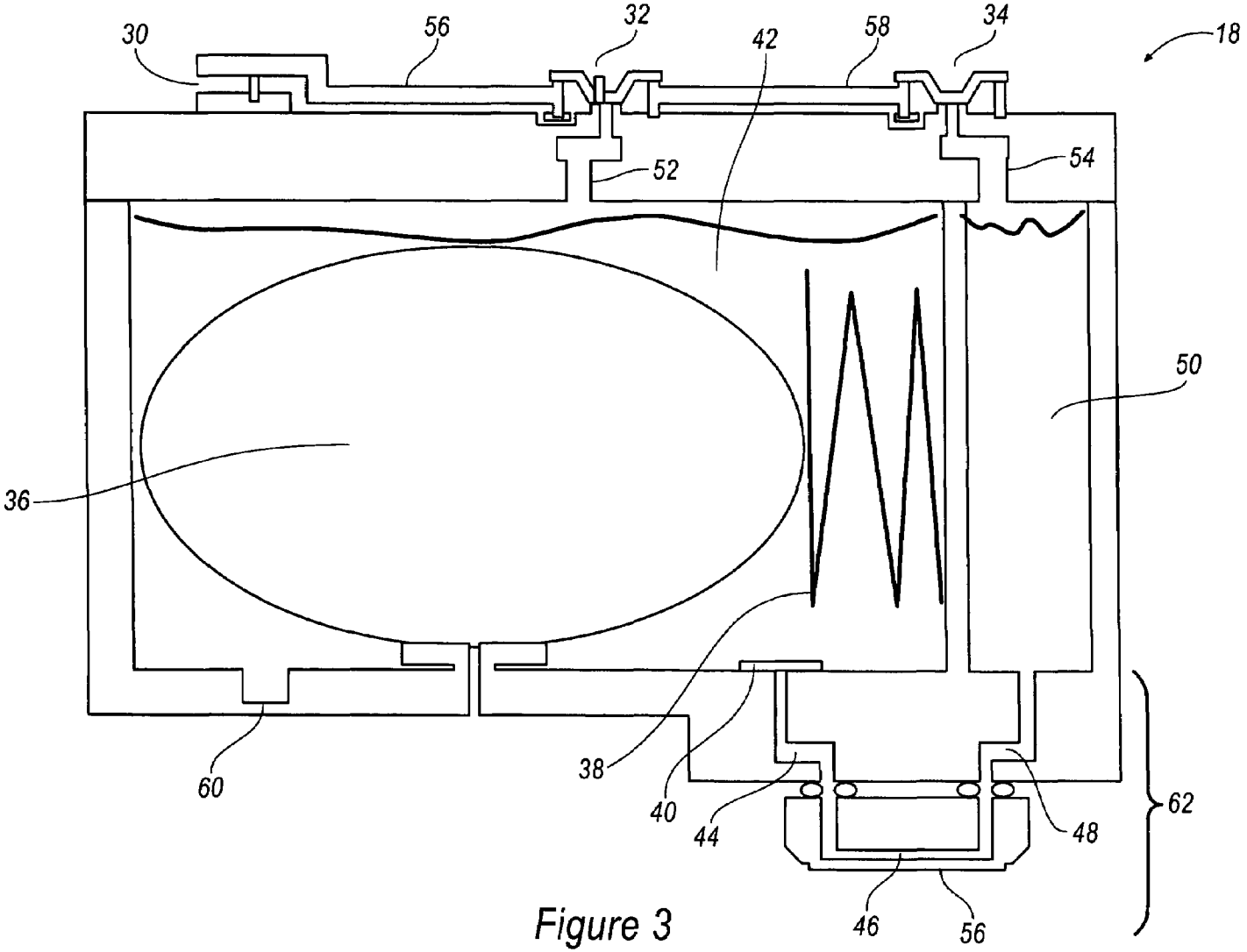
FIG. 3 illustrates a close-up cross-sectional view of a printhead assembly included in the ink delivery system of FIGS. 1 and 2, according to an embodiment.

FIG. 3 illustrates a close-up cross-sectional view of an exemplary printhead assembly 18. FIG. 3 shows only the components corresponding to a single reservoir for a single color. It is understood that printhead assembly 18 includes a reservoir (and associated components shown and described in FIG. 3) for each color printable by the printing system. One of the tubes 21(*a-f*) (in FIG. 2) is connected to printhead inlet 30 to provide fluid communication between the off-axis ink supply container 12 and the printhead assembly 18. Inlet 30 is fluidically connected to three-way inlet valve 32. One port of inlet valve 32 is connected to fluid channel 56; one port of inlet valve 32 is connected to fluid channel 58; and the third port of inlet valve 32 is connected to fluid channel 52. When valve 32 is open to fluid channel 52, ink is permitted to flow into reservoir 42. Each reservoir 42 includes an accumulator bag 36 and spring 38 along with a bubbler 60 to maintain a slight negative pressure in the reservoir 42, as is known in the art. A particle filter 40 separates the reservoir 42 from the lower body portion 62 of the print head assembly 18. As needed, ink may flow through particle filter 40 into inlet channel 44 and ultimately into plenum 46, which resides directly above a slot (not shown). The slot ultimately feeds a thermal printing device (not shown), which ejects ink through nozzles (not shown) disposed in the bottom side 56 of the lower body portion 62 of the printhead assembly 18, according to methods known in the art. The plenum 46 is also fluidically-connected to a two-way recirculation valve 34 via a flow path, which is shown in FIG. 3 as comprising a fluid channel 48, a standpipe 50 and a fluid channel 54. Recirculation channel 48, snorkel 50 and fluid channel 54 may all be generically and collectively referred to herein as fluid flow paths. Recirculation valve 34 is fluidically-connected to inlet valve 32 via fluid channel 58.

Referring generally to FIGS. 1-3, the relevant operation of the print system will now be described. A bulk supply of each ink is stored in its own ink supply container 12(*a-f*). A relatively small amount (typically, about 2-3 cc) of each ink is stored in the corresponding reservoirs 42 on the printhead assembly 18. To generate text and/or images on a print medium, the printhead assembly causes ink droplets to be ejected from the nozzles (not shown) on the bottom surface 56 of the printhead assembly 18 according to methods known in the art. As ink droplets are ejected from the nozzles, ink is drawn from reservoir 42 into inlet channel 44 and plenum 46 to replace the ejected ink. As ink is drawn from reservoir 42, it passes through particle filter 40 to remove undesirable particles in the ink. The particle filter 40 is so fine that it prevents air from passing there-through.

Figure 4:
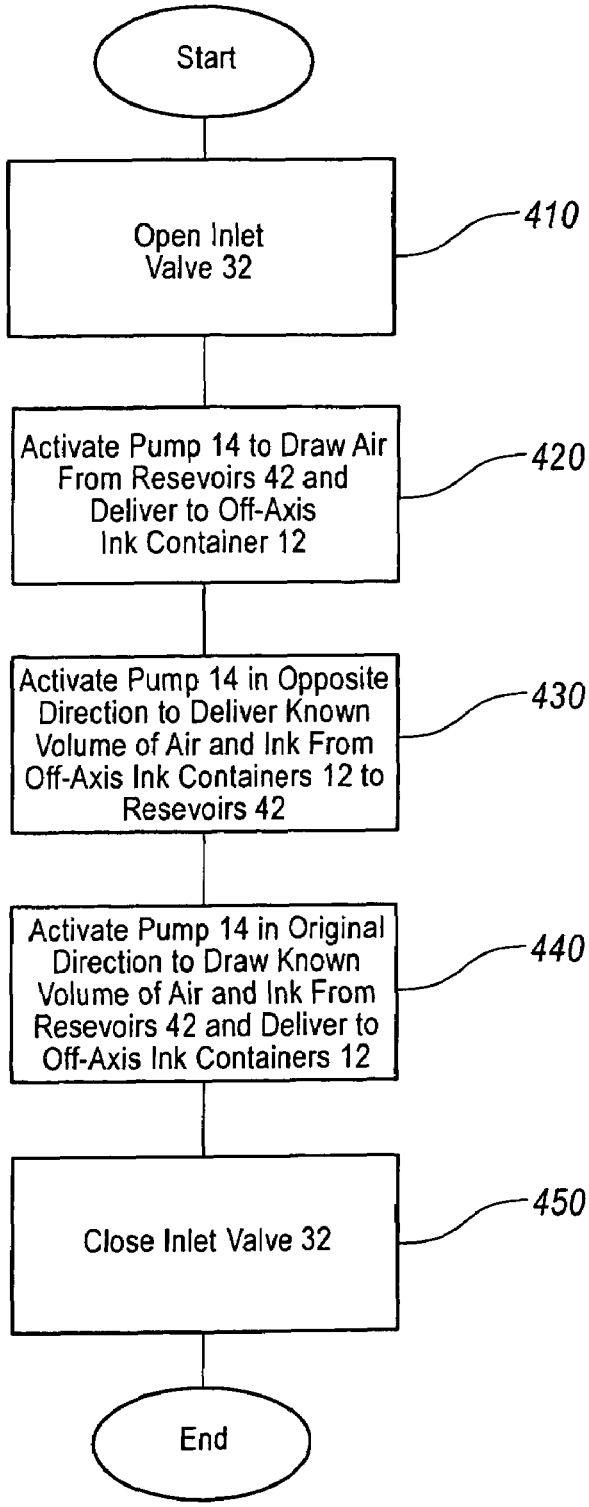
FIG. 4 is a flow chart, illustrating exemplary steps of a "recharge" algorithm, according to an embodiment.

At various times, the reservoirs 42 are "recharged" with ink by drawing ink from the off-axis ink containers 12 into the corresponding reservoirs 42. The reservoirs 42 can be "recharged" based on various "triggering events", such as between print jobs or when the ink level in the reservoir dips to a certain pre-defined level. Referring to FIG. 4, the steps for one exemplary "recharge" algorithm are described in more detail. At step 410, the inlet valve 32 is opened to provide a flow path into reservoir 42. The inlet valve 32 can be opened using various techniques, such as, for example, causing the printhead assembly 18 to move to a predefined location along the shaft so as to mechanically open the inlet valve 32. At step 420, pump 14 is activated so as to draw air and ink from reservoir 42 through inlet valve 32 and to deliver the air and ink to the off-axis ink container 12, where it is pumped through the ink container and vented to atmosphere through vent chambers (not shown). The pump 14 draws a pre-determined volume of fluid from each reservoir 42, which is monitored based on the degrees of rotation of pump 14. Normally, the ink levels in each of the reservoirs 42 will be different as a result of using different amounts of the various colors. The pre-determined fluid volume is typically chosen so as to ensure that all free air has been removed from all of the reservoirs 42, regardless of the different ink level in the different reservoirs. As the air is pumped from the reservoirs 42, the accumulator bag 36 inflates to replace the volume of air removed. When the accumulator bag 36 becomes fully inflated, the bubble generator 60 begins to operate. Because of the differences in the ink/air volume in each reservoir 42 at the beginning of the "recharge" cycle, each accumulator bag 36 will become fully inflated at a different time. The bubble generators 60 act as a kind of pressure relief valve so that the accumulator bags 36 that become fully inflated first, but do not become over inflated. Furthermore, the pressure at which the bubble generators bubble air is significantly lower than the bubble pressure of the nozzles such that, during a "purge" cycle, the nozzles don't ingest air into the standpipe region of the printhead.

After all of the accumulator bags 36 are fully inflated, the direction of the pump 14 is reversed at step 430 so as to pump a known volume of air and ink from the off-axis ink containers 12 to the reservoirs 42. The actual volume of air/ink pumped into reservoir 42 may be monitored based upon the volume per pump cycle and the number of pump cycles of pump 14, as above. The air/ink sensor 24 is used to determine what proportion of the known air/ink volume pumped into the reservoirs 42 is ink and what proportion is air. The known volume of air/ink is predetermined so that any reservoirs 42 that were completely depleted of ink before the "recharge" method was employed are now full of ink and that reservoirs 42 that were not completely depleted before the "recharge" method was employed are "overfull" (the reservoirs 42 and accumulator bags 36 are sized to accommodate the "overfull" situation without spilling ink).

At step 440, the direction of pump 14 is again reversed to its original direction. Pump 14 now draws a known volume of air and ink from reservoirs 42. The ink is returned to the off-axis ink container 12 and the air is vented through the off-axis ink container vent chamber (not shown). After step 440, all air has been removed from the reservoirs 42. Further, an appropriate amount of fluid back pressure has been set in the printhead 18 to ensure optimal printing. Further the ink level in each reservoir has been set. At this point, inlet valve 32 is closed at step 450. Thereafter, the printing device is ready to print again.

While the above-described "recharge" algorithm effectively recharges the reservoir 42, removes air from the reservoir 42, and resets the fluid back pressure in the printhead assembly 18, it is not effective at removing accumulated air from the lower body 62 of printhead assembly 18 downstream of filter 40, including channels 44, 46, and 48, snorkel 50 and channel 54. As previously indicated, filter 40 is commonly sufficiently fine as to prevent air from passing through. Thus, air that has accumulated downstream of particle filter 40 (in the lower body 62) cannot be evacuated through reservoir 42. Therefore, a "purge" algorithm can be performed in the print system periodically to remove air that has accumulated in the lower body 62 downstream of the filter 40. The purge algorithm can be initiated based upon a variety of different triggering events, such as after a certain amount of ink has been ejected from the printhead nozzles, directly after a "recharge"

cycle, after a certain elapsed time, or by the manual initiation of the user (e.g., pushing a button on the print system), for example.

Figure 5:
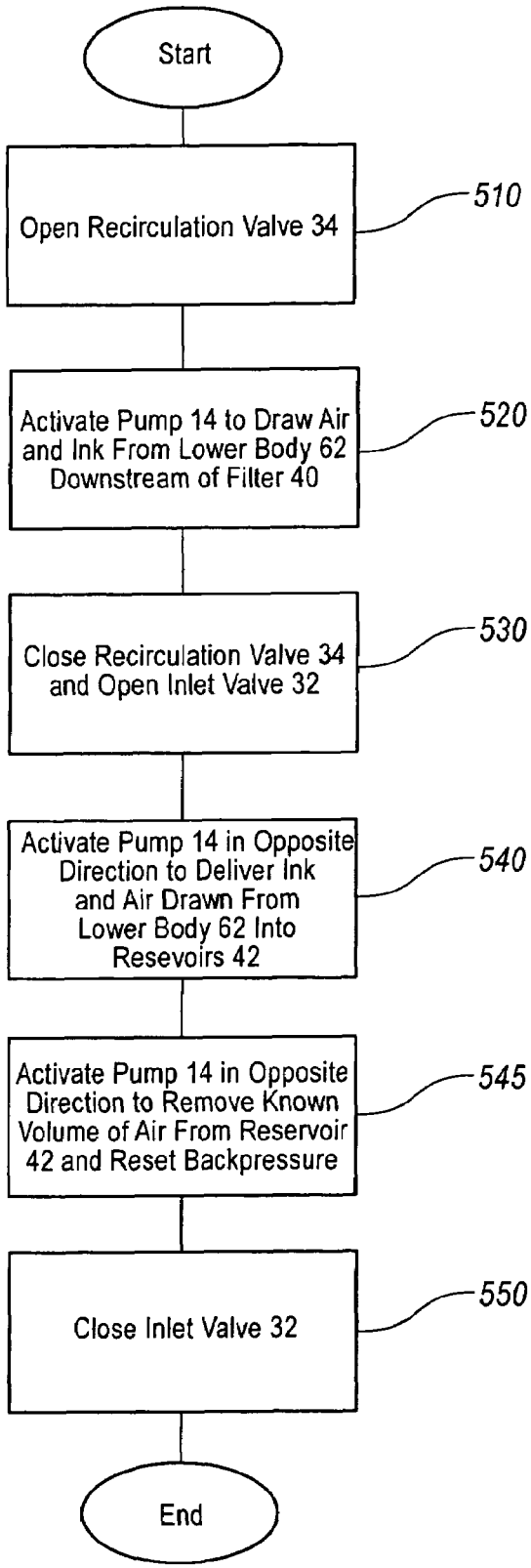
FIG. 5 is a flow chart, illustrating exemplary steps of a "purge" algorithm, according to an embodiment.

The "purge" algorithm may also be used to aid in the recovery of plugged nozzles that result from long duration storage. By moving fresh ink into the lower body 62, including fluid flow paths 44, 46, 48, 50 and 54, the viscous fluid made up of non-volatile solvents that is present in the firing chamber is diluted with ink vehicle containing a sufficient concentration of water so as to enable the formation of a drive bubble that is capable of firing a drop which carries with it the accretion. As a result, any accretions that may have formed in the nozzles of the printhead assembly 18 will be removed With reference to FIG. 5, steps of an exemplary "purge" algorithm are described. At step 510, recirculation valve 34 is opened. As above, a variety of techniques may be used for opening the recirculation valve 34, including, for example, moving the printhead assembly to a predefined location on the shaft so as to mechanically open the recirculation valve 34. At step 520, pump 14 is activated so as to draw air and ink from the lower body 62 of printhead assembly 18 (downstream of filter 40). The pump draws a known volume of air and ink from the lower body 62, including fluid flow paths 44, 46, 48, 50 and 54, back into tube 21. The known volume is predetermined so as to remove all air and ink from the portion of the printhead assembly downstream of the filter 40.

At step 530, the recirculation valve 34 is closed and the inlet valve 32 is opened. At step 540, the pump 14 is activated in the opposite direction so as to pump the air and ink just removed from the lower body 62 back into reservoir 42. In this way, ink removed from the lower body 62 downstream of filter 40 is not wasted.

At step 545, the pump is again reversed and a known volume of air is then removed from reservoir 42 so as to reset the backpressure in reservoir 42.

At step 550, inlet valve 32 is closed. At this point, all air has been removed from the lower body 62, downstream of filter 40.

The above-described "recharge" algorithm includes steps for removing accumulated air from the reservoir 42 of the printhead assembly 18, and the above-described "purge" algorithm removes air from the lower body 62 of printhead assembly 18 downstream of filter 40. Together, the "recharge" and "purge" algorithms remove accumulated air from the printhead assembly 18, both upstream and downstream of the filter 40, without ejecting ink from the nozzles. Thus, there is little or no ink wasted when removing the air, and, accordingly, there is no little or no need for waste components to dispose of expelled ink. Moreover, the "purge" routine effectively removes accretions from the nozzles of the printhead assembly 18. Further, the "recharge" routine, in addition to removing accumulated air from the reservoir 42, delivers ink from the off axis ink supply, resets the backpressure in the printhead assembly, and sets the ink level in the printhead reservoirs to ensure optimal printing capability.

Figure 6:
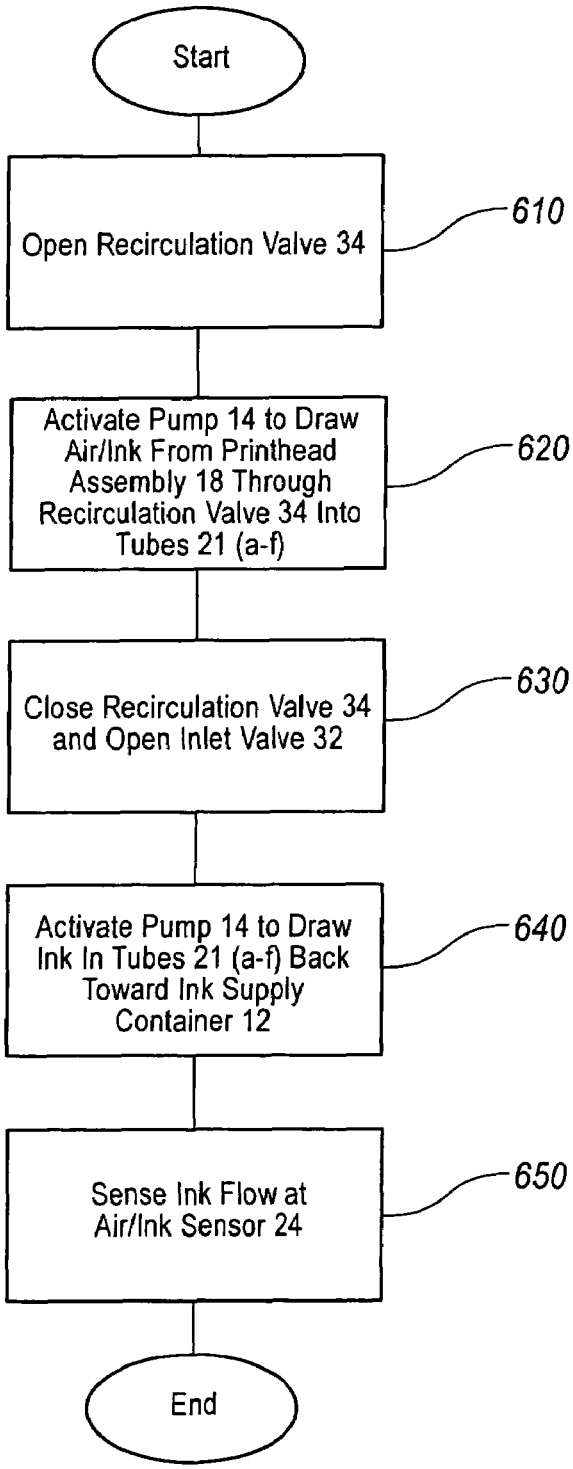
FIG. 6 is a flow chart, illustrating exemplary steps of an "obstruction detection" algorithm, according to an embodiment.

FIG. 6 illustrates an "obstruction detection" algorithm that can be selectively implemented in the above-described printing device. The "obstruction detection" is configured to determine if an obstruction to the ink flow exists somewhere in the tubes 20 and 21. Obstructions can occur in the tubes 20 and 21 as a result of a kink, for example. Such obstructions may ultimately cause leaks in the printing device as a result of trying to pump ink past the obstructions. With reference to FIG. 6, the "obstruction detection" algorithm begins by opening the recirculation valve 34, as shown at step 610. Then, pump 14 is activated to draw a predetermined amount of ink from the printhead assembly 18 through recirculation valve 34 into tube 21, as shown in step 620. As described hereinafter, the drawn ink—referred to herein as an "ink slug"—is used to determine if there is an obstruction in the ink flow path. Accordingly, the determined amount of ink is normally relatively small. Thereafter, the recirculation valve 34 is closed and inlet valve 32 is opened, as shown at step 630. Pump 14 is activated to draw the ink now in tube 21 back toward ink supply container 12, as shown at step 640. As the ink slug passes through tube 21, it necessarily passes through air/ink sensor 24. The air/ink sensor 24 determines when the ink slug passes, as shown in step 650. Using the output of the air/ink sensor 24, a controller or other control circuitry (not shown) determines the elapsed time required for the ink slug to pass by the air/ink sensor 24. If there are no obstructions in the ink flow path (i.e., in the printhead assembly and in the tubes 20 and 21), the ink slug will pass by the air/ink sensor 24 after a known elapsed time. If an obstruction exists somewhere in the ink flow path, then the ink slug will either not pass by the air/ink sensor at all or it will pass by after an elapsed time different than that which is expected or not at all. That is, the ink slug will move through the tubes more slowly than expected. If an obstruction is detected, a variety of actions can be taken, including activating an error message on the printer and/or activating a "purge" routine to attempt to remove an accretion that may have formed in the nozzles, for example.

While the present invention has been particularly shown and described with reference to the foregoing preferred embodiment, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiment is illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

The invention claimed is:

1. In a printhead assembly having at least one ink reservoir and one standpipe separated by a particle filter, said printhead assembly being fluidically connected to at least one off-axis ink supply container by at least one tube, a method for controlling effects of accumulated air in said printhead assembly, comprising:

drawing air from said printhead assembly through said standpipe into said tube;

drawing air from said printhead assembly through said reservoir into said tube, including drawing ink from said reservoir in addition to said air; and delivering said air withdrawn from said printhead assembly to said off-axis ink supply container.

2. In a printhead assembly having at least one ink reservoir and one standpipe separated by a particle filter, said printhead assembly being fluidically connected to at least one off-axis ink supply container by at least one tube, a method for controlling effects of accumulated air in said printhead assembly, comprising:

drawing air from said printhead assembly through said standpipe into said tube;

drawing air from said printhead assembly through said reservoir into said tube; and delivering said air withdrawn from said printhead assembly to said off-axis ink supply container.

3. The method of claim 2, further comprising the step of delivering a known volume of air and ink from said oft-axis ink supply container to said printhead assembly.

4. The method of claim 3, wherein said known volume is predetermined so as to ensure that said reservoir is substantially filled with ink, regardless of the ink level in said reservoir prior to performing said delivering step.

5. The method of claim 3, further comprising the step of drawing a known volume of fluid from said reservoir to set a desired backpressure level within said printhead assembly.

6. In a printhead assembly having at least one ink reservoir and one standpipe separated by a particle filter, said printhead assembly being fluidically connected to at least one off-axis ink supply container by at least one tube, a method for controlling effects of accumulated air in said printhead assembly, comprising:

drawing air from said printhead assembly through said standpipe into said tube, including activating a bi-directional pump in a first direction;

drawing air from said printhead assembly through said reservoir into said tube;

delivering said air drawn from said printhead assembly through said standpipe into said reservoir, including activating said bi-directional pump in a second direction, said second direction being opposite said first direction.

7. The method of claim 6, wherein said step of drawing air through said standpipe includes opening a first valve to fluidically-connect said standpipe to said tube and wherein said step of delivering said air into said reservoir includes opening a second valve to fluidically-connect said reservoir to said tube.

8. In a printhead assembly having at least one ink reservoir and one standpipe separated by a particle filter, said printhead assembly being connected to at least one off-axis ink supply container by at least one tube, a method for controlling effects of accumulated air in said printhead assembly, comprising:

opening a first valve to fluidically-connect said standpipe to said tube;

activating a bi-directional pump interposed in said tube in a first direction to draw air and ink from said printhead assembly into said tube through said standpipe;

closing said first valve;

opening a second valve to fluidically-connect said tube to said reservoir;

activating said bi-directional pump in a second direction, opposite said first direction, to deliver said air and ink drawn through said standpipe into said reservoir; and monitoring the amount of fluid drawn through said standpipe.

9. The method of claim 8, further comprising:

activating said bi-directional pump in said first direction to draw fluid from said reservoir and deliver said fluid to said off-axis ink supply container, at least a portion of said fluid comprising air;

activating said bi-directional pump in said second direction to deliver a predetermined amount of fluid from said off-axis ink supply container to said reservoir, at least a portion of said predetermined amount of fluid comprising ink; and activating said bi-directional pump in said first direction to draw a predetermined amount of fluid from said reservoir to set a desired level of backpressure in said reservoir.

10. The method of claim 9, further comprising the step of monitoring the amount of fluid drawn from said reservoir and delivered to said reservoir.

11. A method for controlling effects of accumulated air in a printhead assembly, wherein the printhead assembly includes an upper portion and a lower portion, the upper portion having at least one reservoir fluidically connected to a standpipe through a first valve and a second valve and a fluid channel therebetween, the method comprising:

opening a first valve to fluidically connect the lower portion of the printhead assembly to a tube;

activating a bi-directional pump to draw a predetermined volume of air and ink from the lower portion of the printhead assembly into the tube;

closing said first valve to disconnect the fluid connection between the lower portion of the printhead assembly and the tube;

opening a second valve to fluidically connect the tube to the reservoir;

activating said bi-directional pump in an opposite direction, pumping said predetermined volume of air and ink from the tube into the reservoir.

12. The method of claim 11, wherein said predetermined volume of air and ink is drawn from the lower portion of the printhead assembly to the tube through the standpipe.

* * * * *

UNITED STATES PATENT AND TRADEMARK OFFICE

CERTIFICATE OF CORRECTION

PATENT NO. : 7,510,274 B2
APPLICATION NO. : 11/040941
DATED : March 31, 2009
INVENTOR(S) : Jeremy A Davis et al.

It is certified that error appears in the above-identified patent and that said Letters Patent is hereby corrected as shown below:

On the Title page, in field (75), in "Inventors", in column 1, line 12, delete "Monmouth, OR" and insert -- Vancouver, WA --, therefor.

In column 7, line 8, in Claim 3, delete "oil-axis" and insert -- off-axis --, therefor.

Signed and Sealed this

Eighteenth Day of August, 2009

David J. Kappos

David J. Kappos
*Director of the United States Patent and Trademark Office*